US005199507A

United States Patent [19]

Westmoreland

[11] Patent Number: 5,199,507

[45] Date of Patent: Apr. 6, 1993

[54] PORTABLE DRILLING SYSTEM

[76] Inventor: Harry L. Westmoreland, 1306 Ravenscourt, Sugar Land, Tex. 77478

[21] Appl. No.: 831,773

[22] Filed: Feb. 5, 1992

[51] Int. Cl.[5] ..... E21C 5/06

[52] U.S. Cl. ..... 173/147

[58] Field of Search ..... 173/18, 28, 58, 147

[56] References Cited

U.S. PATENT DOCUMENTS

| | | | |
|---|---|---|---|
| 1,763,701 | 6/1930 | Hansen | 173/147 |
| 2,090,479 | 8/1937 | Hart | 173/147 |
| 2,726,065 | 12/1955 | Feucht | 173/147 |
| 3,149,540 | 9/1964 | Lindgren et al. | 173/147 |
| 3,155,171 | 11/1964 | Kurt et al. | 173/147 |
| 3,162,253 | 12/1964 | Curtis | 173/147 |
| 3,502,543 | 3/1970 | Sewell | 175/24 |
| 3,719,238 | 3/1973 | Campbell et al. | 173/147 |
| 3,721,305 | 3/1973 | Mayer et al. | 173/147 |
| 4,371,041 | 2/1983 | Becker et al. | 173/147 |
| 4,545,442 | 10/1985 | Warner et al. | 175/220 |
| 4,671,365 | 6/1987 | Back et al. | 173/28 |

*Primary Examiner*—Douglas D. Watts
*Assistant Examiner*—Scott A. Smith
*Attorney, Agent, or Firm*—C. Milton Fick

[57] ABSTRACT

A manually portable drilling system for the purpose of drilling earth bore holes. The drilling system will accommodate a lightweight drill pipe for air or mud rotary drilling, auger, or with use of air hammer percussion tools. The drilling system includes a self-contained mast which is detachable from a support base table. The mast contains an internal traveling shuttle to which a power unit is attached. The shuttle is manually driven by a conventional two speed, reversible hand winch modified to allow both hoisting and pull down capabilities. A partially hollow, perforated quill is coupled to an output drive of the power unit and drill pipe. This drilling system may be set up or broken down in minutes and carried to areas inaccessible by conventional portable drilling machines.

2 Claims, 5 Drawing Sheets

Fig. 2
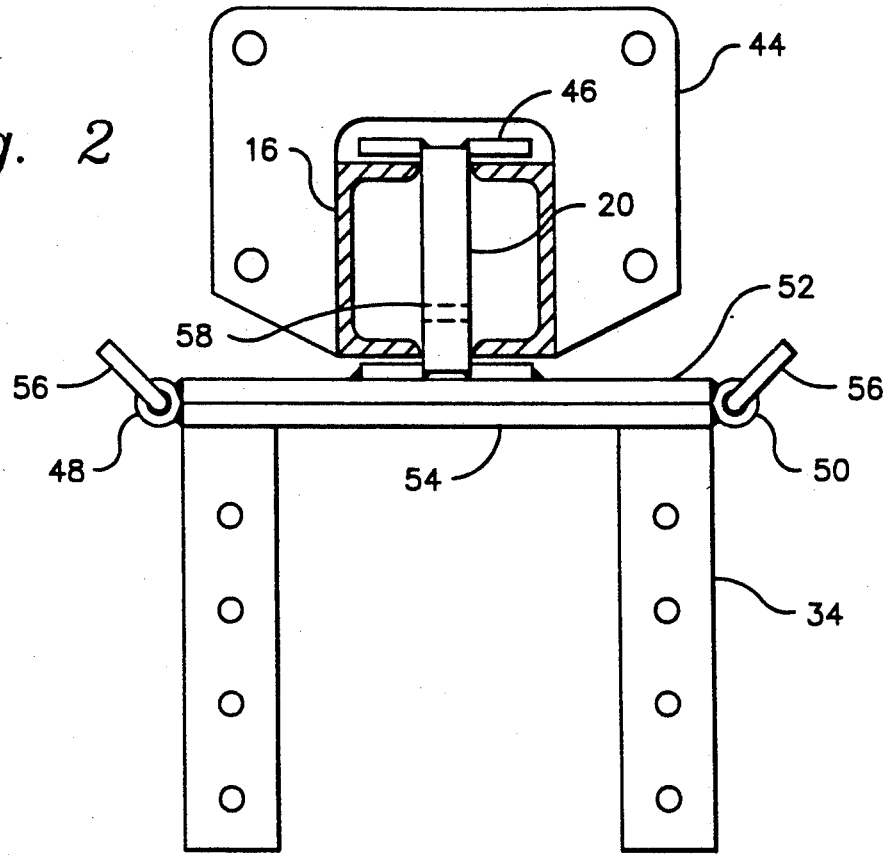
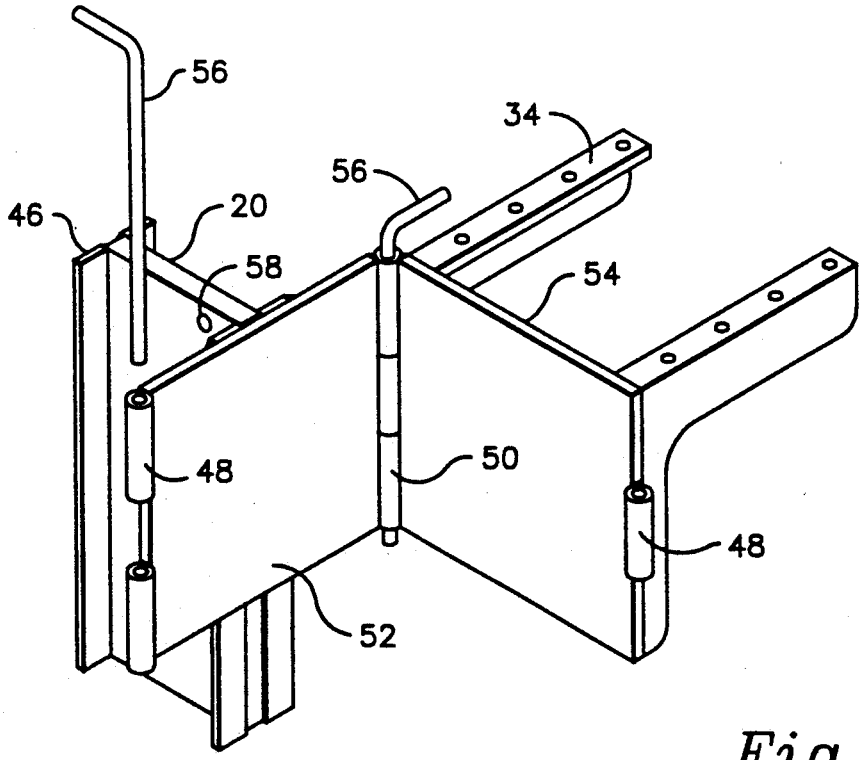
Fig. 3

PORTABLE DRILLING SYSTEM

FIELD OF THE INVENTION

The present invention relates generally to equipment useful in drilling earth bores holes. More specifically, this invention concerns a light-weight, portable drilling rig capable of drilling shallow water wells and which may be disassembled and manually transported to areas not previously accessible to drilling equipment.

BACKGROUND OF THE INVENTION

In many areas of the country and throughout the world, it remains extremely difficult to transport to a location drilling equipment necessary to drill shallow water wells. Inadequate or nonexistent roads prevent conventional, heavy truck mounted water well drilling equipment from reaching the desired location. Because the substantial roads required by such conventional truck mounted equipment are not available in many areas in underdeveloped countries, large areas throughout the world are effectively isolated from equipment necessary to drill water wells. A small, light weight, easily portable drilling system is needed that would allow shallow water wells to be drilled in currently isolated areas. The present invention addresses this critical need.

The present invention includes a drilling rig which may be easily disassembled and manually transported to drill bore holes in even the most remote areas on earth. The described drilling system includes a detachable mast, shuttle, winch assembly, power unit, and diverter valve which are easily disassembled from a support table to aid in transport. The winch assembly is attached to the mast and shuttle assembly through a chain to move the shuttle and power unit (connected to the shuttle) vertically up or down along the mast. The winch assembly includes a modified hand winch which accommodates a roller chain sprocket and is positioned on the mast as not to interfere with the travel of a power unit mount bracket attached to the shuttle. The hand winch has two gear ratios for varying pulldown or hoist loads or applications. The shuttle utilizes a hinge arrangement to allow the power unit to be pivoted out from over the bore hole or completely removed from the mast to aid in transport. The diverter valve is located on the mast to allow quick diversion of drilling fluid or air from the bore hole to a mud pit or visa versa. The location of the valve also allows hoses to travel freely and out of the way of the drilling operations.

The support table is equipped with a slide action pipe/casing slip and removable stabilizer support tubes. The support table is fabricated so as to allow the mast to be easily removable so the moderately weighted base table and mast can be hand transported separately.

A mast stay at the crown of the mast is fitted with clevises for tie down ropes necessary to secure the rig during operations where pulldown pressure is needed to make the bit penetrate and cut. The tie down ropes also help stabilize the mast during drilling operations.

A quill provides a means of connecting the power unit to the drill pipe and allows drilling fluid or air from a pump or compressor unit to enter the drill pipe through a side port. The quill is coupled to a power output shaft from the power unit.

A swivel housing is rigidly mounted to the rotary power unit mount but able to be adjusted to relieve any side load from the compression seals in the top and bottom of the swivel housing. The swivel housing is completely removable from the quill. By removing the bolt, the housing may be pulled from the bottom to allow greasing of the compression seals.

The present invention satisfies an important need not met by currently available drilling equipment. A primary advantage of this invention is that it provides a simple rotary drilling rig that is truly manually portable for transport into areas where other power drilling rigs could not be brought or taken except through helicopter transport. The present invention provides a drilling system with a durable mast and base unit and simple, commonly available components that are easily replaceable in the field to eliminate rig downtime for repair of worn parts. The system described is so simple enough to operate and repair that a person with only limited drilling experience can safety and effectively operate the rig after a short training period is completed.

An additional advantage of the present invention is that, despite its compact design, pulldown pressure can be applied to the drill pipe during bore hole drilling. Yet another advantage over other available drilling rigs is the ability to rotate or remove the power unit from over the bore hole without removing the mast or the rest of the rig. The described invention also includes a compact support base table that allows for the rapid threading and unthreading of drill pipe and surface casing through the use of slide action slips. Another advantage provided is a swivel arrangement that allows the power unit output to be connected to the drill pipe through a quill arrangement that may be used to direct air or drilling mud to the drill bit.

All these advantages of the present invention result in a lightweight, simplified, inexpensive drilling system that can drill water wells to depths of up to 200 feet in areas not currently accessible to conventional water well drilling equipment.

SUMMARY OF THE INVENTION

The present invention is a lightweight, manually portable drilling system capable of drilling shallow water wells or other bore holes. This invention is characterized by its lightweight, simplified construction that allows the drilling system to be easily disassembled, transported to the desired water well location, quickly reassembled, and put into operation.

In the basic embodiment of the drilling system, a shuttle is slidably mounted inside a drilling mast. Attached to the shuttle is a power unit mounting bracket to which a rotary or other other power unit may be attached to power a drill bit, auger, or other earth penetrating device. A chain and winch assembly are used to raise and lower the shuttle and power unit as required during drilling operations.

BRIEF DESCRIPTION OF THE DRAWINGS

FIG. 2 shows a cross-sectional plan view of a mast, shuttle, and shuttle track guide of the present invention.

FIG. 3 shows a perspective view of the shuttle and shuttle track guide of the present invention.

These drawings are not intended in any way to limit the present invention, but are provided solely for the purposes of illustrating certain preferred embodiments and applications of the present invention.

DETAILED DESCRIPTION OF THE PREFERRED EMBODIMENT

The present invention is a manually portable well drilling rig useful in drilling shallow water wells or other shallow wellbores. The invention is capable of drilling wellbores up to 200 feet in depth in areas not previously accessible to drilling equipment. The drilling system can be easily disassembled using small hand tools into pieces which can be carried by one or two individuals. The drilling system can then be moved to a location where the shallow water well or other bore hole is desired and quickly reassembled with the same small hand tools.

The drilling system can accommodate light weight pipe for use with air, mud, or auger drilling, or with use of an air hammer and percussion tools. The rotary, auger, or air hammer unit is attached to a shuttle assembly which is slidably mounted inside a self-contained, detachable mast. The shuttle is lowered or lifted through forces applied to a winch and chain arrangement attached to the mast.

Figure 1:
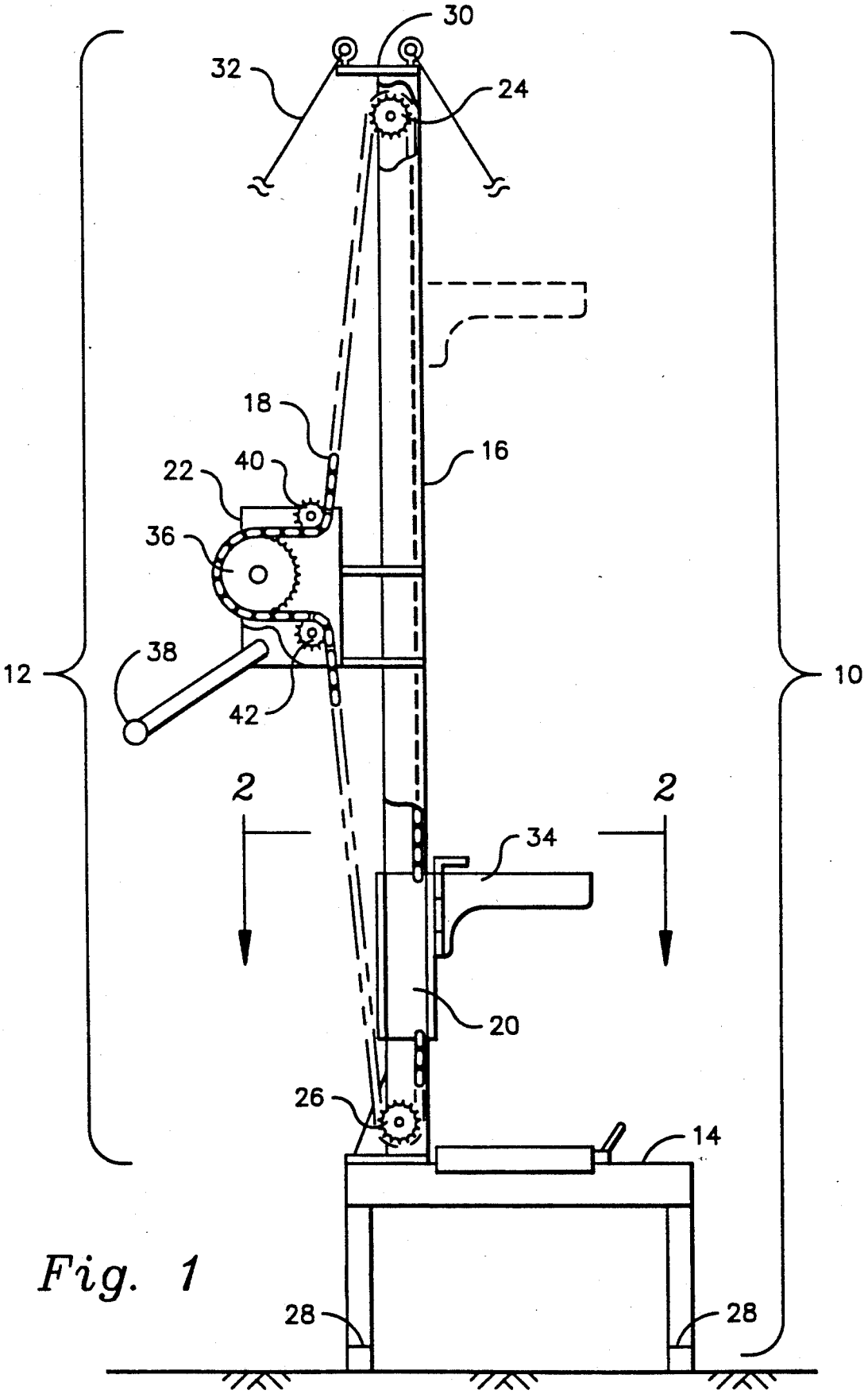
FIG. 1 shows a side view, partly in section, of a preferred embodiment of the present invention.

FIG. 1 shows a perspective view of a preferred embodiment of the invention. In FIG. 1, portable drilling system 10 is shown assembled and sitting on the ground. Mast assembly 12, mounted on support table 14, includes mast 16, chain 18, shuttle 20, winch assembly 22, crown sprocket 24, and base sprocket 26. Table 14, which includes stabilized legs 28, is fabricated from structural steel to provide adequate support to mast assembly 12 while still being lightweight and easily disassemblable and transportable. Table 14 is further described below in FIG. 6.

Mast stay 30 is connected to mast 16 and allows rope or cable 32 to provide support to mast assembly 12 during drilling operations. Mast 16 allows shuttle 20 to be internally installed so it can be manipulated up and down by winch assembly 22. Chain 18 is attached to shuttle 20 at two points inside of mast 16. Shuttle 20 includes power unit mount bracket 34 to which a rotary or other power unit (not shown) may be mounted.

Winch assembly 22 is securely mounted to mast 16 at a point four to five feet above ground surface. Winch assembly 22 includes a conventional two speed reversing hand winch 36 which drives chain 18. Chain 18 is attached to both top and bottom of shuttle 20. Hand winch 36 is powered by winch handle 38. Upper winch mount sprocket 40 directs chain 18 from hand winch 36 to crown sprocket 24, which is internally mounted in mast 16. Similarly, lower winch mount sprocket 42 directs chain 18 from hand winch 36 to base sprocket 26, which is internally mounted in mast 16. The installation of chain 18 in this manner provides a closed loop arrangement through shuttle assembly 20 and winch assembly 22. It has been found that installation of a common chain tensioner arrangement (not shown) at upper winch mount sprocket 40 can assist in maintaining appropriate chain 18 tension during drilling operations.

FIG. 2 shows a cross-sectional plan view of mast 16 and shuttle 20 and shuttle track guide 46. Mast 16 is formed by two sections of channel iron which are held in position by mast stays 44. Mast stays 44 are welded or otherwise connected to mast 16 at various locations along mast 16. In the preferred embodiment, mast stays 44 are cut from flat bar and located to provide adequate stiffness for mast 16. The placement of mast stays 44 allow shuttle 20 to slide freely inside mast 16. Shuttle 20 includes shuttle track guide 46 to which chain 18 is attached. Additional details of shuttle track guide 46 are provided in FIG. 3. Hinge 48 and hinge 50 allow the power unit mount bracket to be rotated away or removed from mast 16. Shuttle 20 is connected to shuttle hinge plate 52. Hinge plate 54 is connected to power unit mount bracket 34 to which a power unit (not shown) may be attached. Hinge pins 56 are shown inserted in hinge 48 and hinge 50. Chain hole 58 extends through shuttle 20.

FIG. 3 shows a perspective view of shuttle 20 and shuttle track guide 46 removed from mast 16 and disconnected from chain 18. In the preferred embodiment, shuttle 20 and shuttle track guide 46 utilize an I shape form which may be fabricated from five pieces of flat bars and attached to the back of shuttle hinge plate 52. On opposite edges of plate 52 are mounted hinges 48 and 50 as indicated in FIG. 3. Hinges 48 and 50 are separable and are utilized to connect shuttle hinge plate 52 to plate 54. Power unit mount bracket is attached to one side of plate 54. Hinge pins 56 are inserted through hinge 48 and hinge 50 to allow plate 54 and power unit mount bracket 34 to be rotated away or removed from plate 52 when shuttle 20 is mounted in mast 16 to allow other operations to be performed over the well bore. Chain 18 is attached to shuttle 20 through chain hole 58. A similar chain attachment hole (not shown) is located at the base of shuttle track guide 46 to allow chain 18 to form a closed loop when connected to the bottom of shuttle 20.

Figure 4:
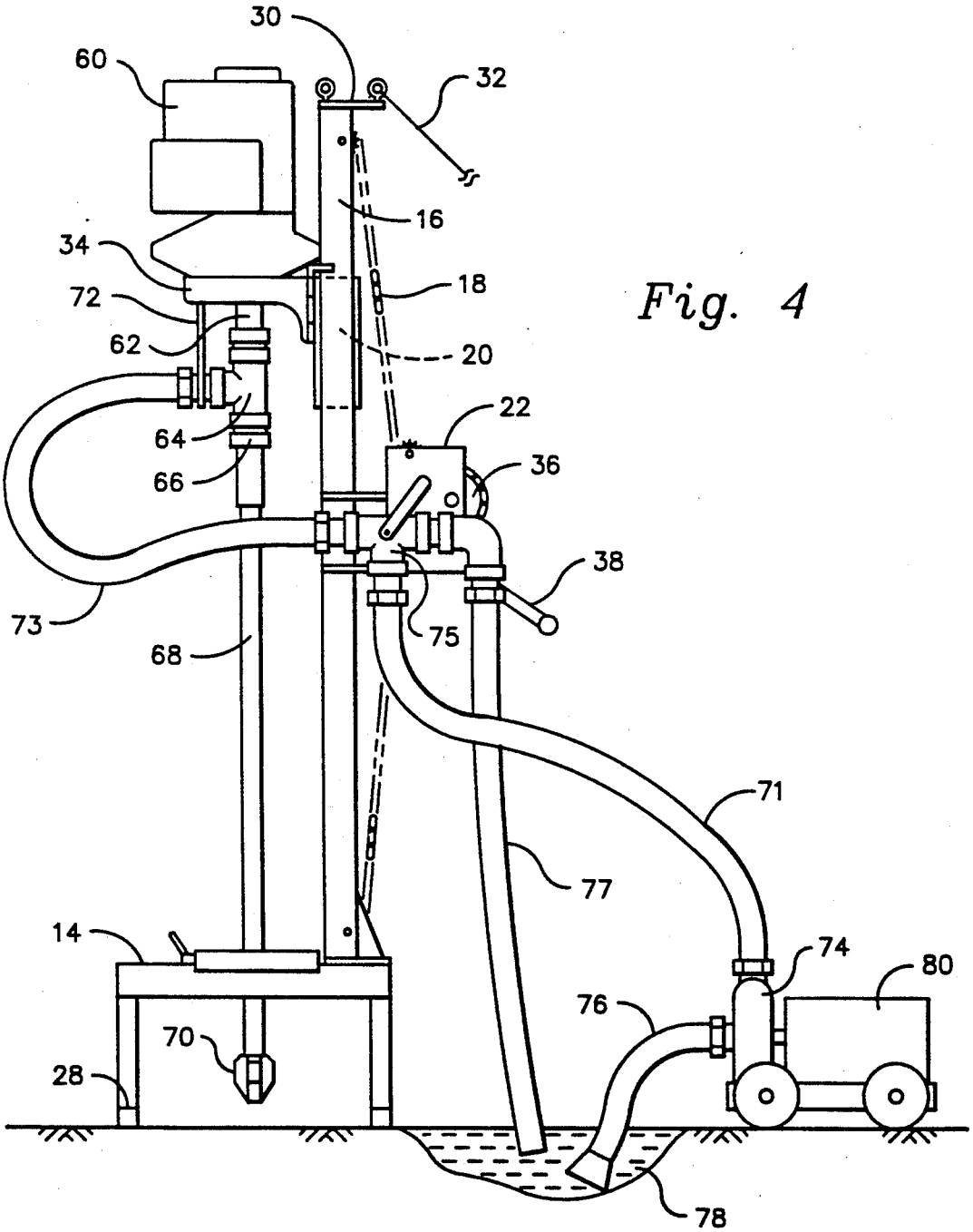
FIG. 4 shows a side view of another preferred embodiment of the present invention which includes a rotary power unit, drill pipe and bit, and associated pump equipment.

FIG. 4 shows a side view of a preferred embodiment of the invention, including a fully assembled drilling arrangement. FIG. 4 shows the opposite side of portable drilling system 10 of FIG. 1 to assist in showing additional features of the present invention. FIG. 4 shows a rotary power unit 60 attached to shuttle 20 through power unit mount bracket 34. Power unit mount bracket 34 will accommodate a conventional engine driven post hole digger with a modified throttle to control engine speed. Although a rotary power unit is shown, the current arrangement is also fully capable of utilizing an auger or percussion and hammer drilling system. Rotary power output shaft 62 extends from rotary power unit 60 into swivel tee 64. Quill 66 is attached to rotary output shaft 62 above swivel tee 64. Quill 66 is partially hollow and perforated and couples rotary power output shaft 62 to rotary drill pipe 68. Additional details of quill 66 are provided in FIG. 5. Attached to rotary drill pipe 68 is drill bit 70.

To provide support for swivel tee 64 is swivel support rod 72 which extends form power unit mount bracket 34. Connected to swivel tee 64 and extending to a port in three way diverter valve 75 is swivel hose 73. Three way diverter valve 75 is a commercially available three port valve which has a single port that is always common to one of the other two ports. Three way diverter valve 75 is mounted securely to winch assembly 22 which is connect to mast 16. Three way valve 75 has a common port that is connected to pump discharge hose 71. The third port in three way diverter valve 75 is connected to mud pit return hose 77. Mud pump 74 discharges mud received through suction hose 76 from mud pit 78 to discharge hose 71. Mud pump 74 is driven by a conventional engine 80. Valve 75 allows mud or other drilling fluids from mud pump 74 through the common port to one of the other two ports which may direct the mud to drill bit 70 through swivel tee 64 or return the mud to mud pit 78 through mud pit return hose 77.

Figure 5:
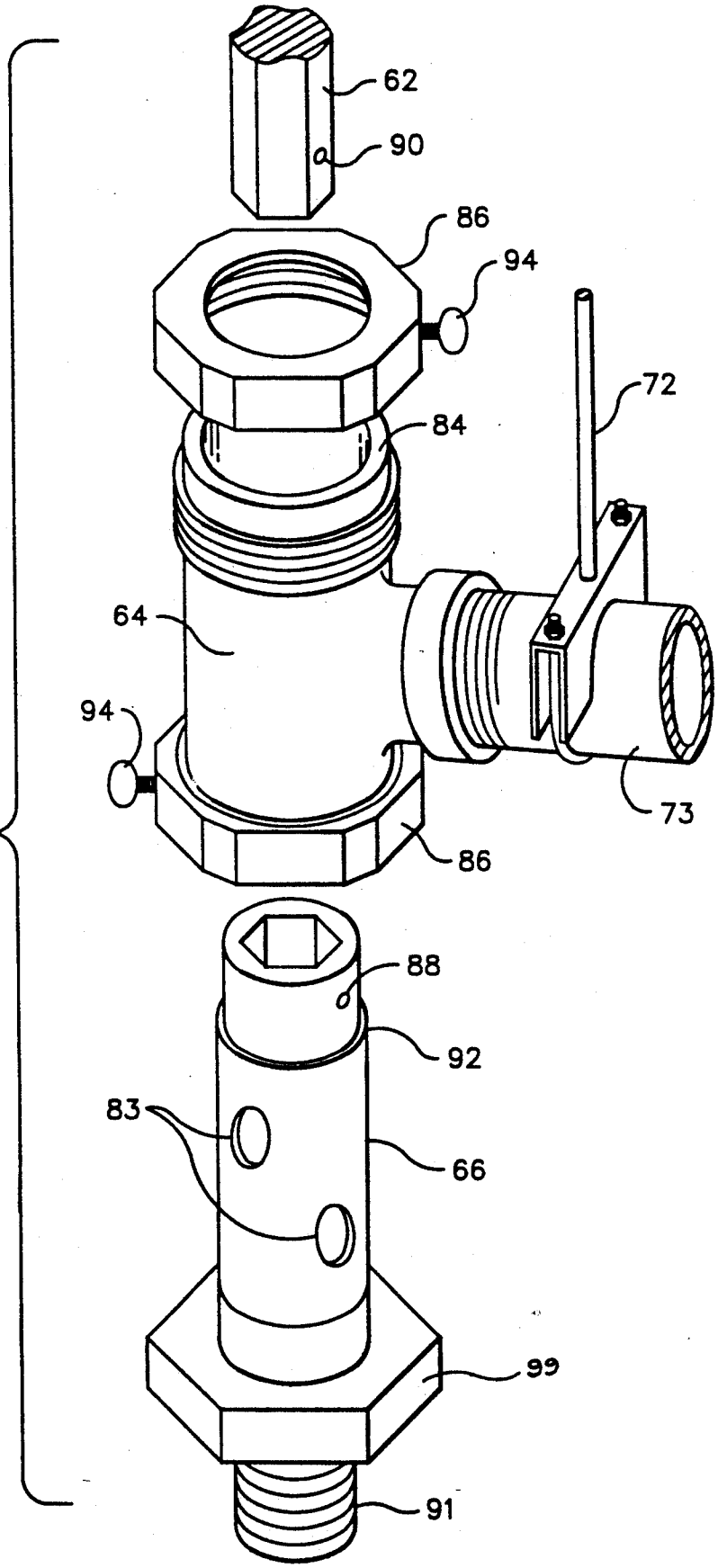
FIG. 5 shows a perspective view of the quill arrangement and swivel tee assembly of the present invention.

FIG. 5 shows a perspective view of a quill arrangement and swivel tee 64 assembly. Quill 66 is a partially hollowed and perforated section of pipe with circulation inlet ports 83. Quill 66 is installed so as to extend up through swivel tee 64, seal 84, and compression caps 86 in order to connect to rotary output shaft 62 from rotary power unit 60. The described quill arrangement eliminates the need for bearings typically required for a swivel arrangement. This simplified arrangement greatly reduces the cost associated with the swivel requirement.

Quill 66 is connected to rotary output shaft 62 through aligning quill coupling pin hole 88 with rotary coupling pin hole 90 and inserting a connecting bolt (not shown) Below quill coupling pin hole 88 and above circulation inlet ports 83 is placed a cap (not shown) that prevents drilling fluids from moving up quill 82 and out around rotary output shaft 62. Quill 66 is then connected at the other end to drill pipe 68 through pipe connector 91. Quill seal 92 contacts seal 84 to provide a leak proof connection while allowing rotary output shaft 62 to turn quill 66 and drill pipe 68 and drill bit 70. Compressions cap 86 provides pressure to the seal arrangement and are secured in place by tightening thumb screws 94. FIG. 5 shows swivel hose 73 threaded into swivel tee 64 and attached to shuttle power unit mount bracket 34 through swivel support rod 72.

At the lower end of quill 66 is pipe connector 91 which connects quill 66 to drill pipe 68.

Figure 6:
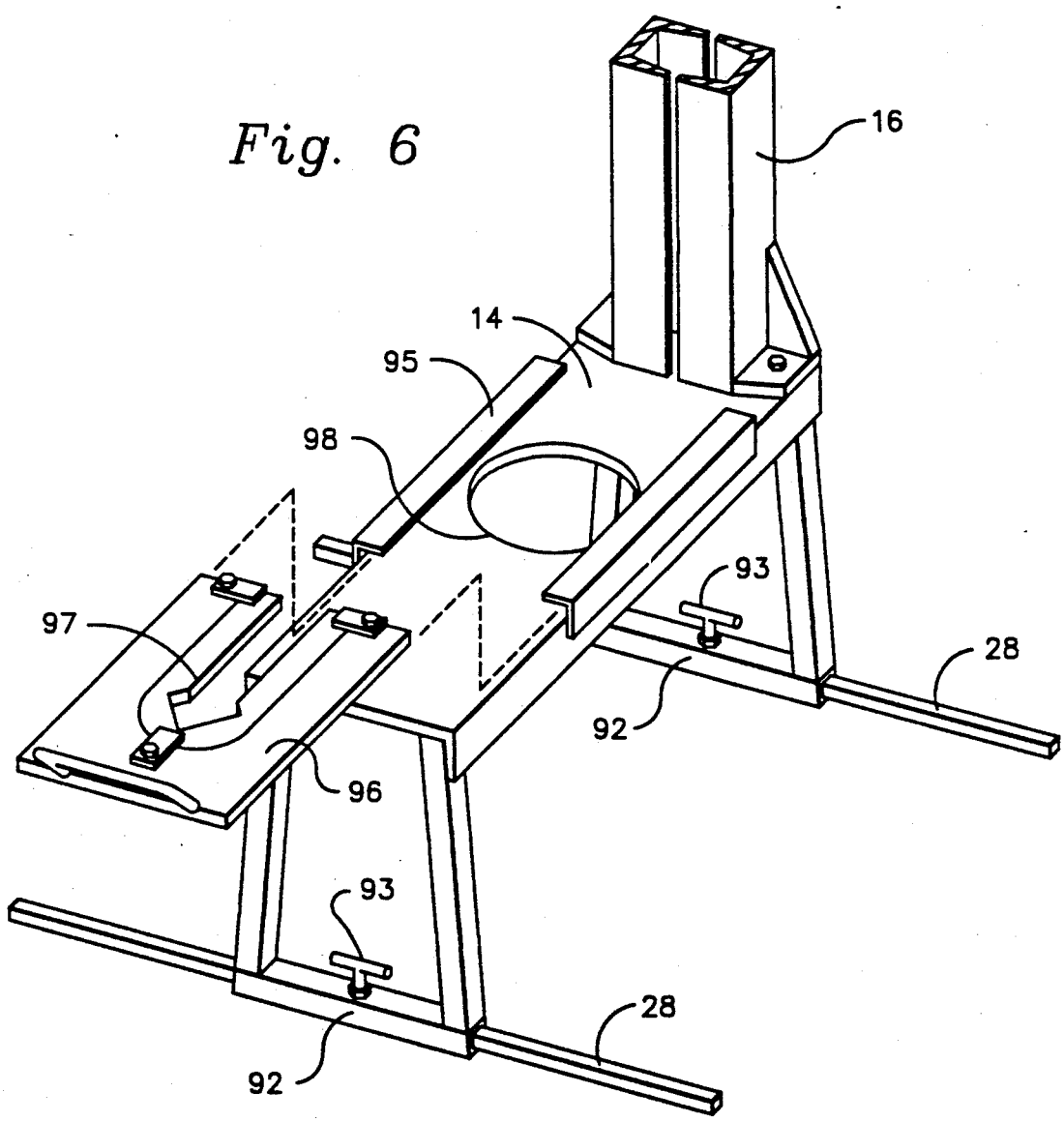
FIG. 6 shows a perspective view of a support table of the present invention.

FIG. 6 is a perspective view of the support table. Support table 14 provides a platform approximately a foot above ground level to which mast 16 may be attached. FIG. 6 shows mast 16 bolted to support table 14. Stabilizer legs 28 insert into support leg tubes 92 to provide balance to support table 14. Stabilizer legs 28 are held into position in support leg tubes 92 by locking bolts 93 and can be removed from tubes 92 to aid in transport of the drilling system. This arrangement provides an elevated platform level to allow easy access to the bore hole for removal of bore hole cuttings and observation of drilling fluids.

Slip guides 95 provide a guide to combination slips 96 to hold in place drill pipe 68 during makeup or breakout during drilling operations. Combination slips 96 are also capable of holding casing when insert 97 is removed from combination slips 96. Insert 97 allows combination slips 96 to provide additional support to drill pipe 68.

OPERATION OF PREFERRED EMBODIMENT

The present invention allows a drilling operation to be performed by a single individual and may be easily disassembled and transported to areas inaccessible to larger rigs. Additionally, the simplicity of the present invention allows an individual with only limited drilling experience to be trained to operate and repair a unit a short period of time.

Operation of the present invention will be discussed with respect to FIG. 3 and FIG. 4. In the preferred embodiment, the described drilling system is fabricated to be disassembled into the following major, separable components: support table 14, mast 16 and winch assembly 22, chain 18, shuttle 20, rotary power unit 60, swivel tee 64, hoses (71, 73, and 77), drill pipe 68 and drill bit 70, and mud pump 74 and engine 80. When a desired bore hole location is reached, shuttle 20 is inserted into mast 16 so it may slide the length of mast 16. Chain 18 is inserted into mast 16 and connected to the top of shuttle 20. Chain 18 is then placed over crown sprocket 24 (reattached after shuttle assembly 20 is inserted into mast 16), guided around upper winch mount sprocket 40, through hand winch 36, over lower winch mount sprocket 42, and around base sprocket 26 back into mast 16. Chain 8 is then connected to the bottom of shuttle 20. It has been found that a master chain link provides the best method of connecting chain 18 to shuttle 20. After shuttle 20 is slidably mounted in mast 16, mast 16 is connected to support table 14.

Support ropes 32 are then connected to mast stay 30 at one end and then tied off to ground anchors, trees, or other strong item to stabilize mast 16 during drilling operations. It has been found that connecting support ropes 32 to mast stay 30 can be best accomplished by using steel shackles (not shown). Such shackles significantly reduce wear on support ropes 32 caused by the motion of mast 16 during drilling and allows them to be used longer.

Quill 66 is then inserted through swivel tee 64 and connected to rotary output shaft 62 with care given that the seals on quill 66 and in swivel tee 64 are properly sealing to prevent drill fluids from existing swivel tee 64. Winch assembly 22 is then engaged to raise the rotary power unit 60 mounted on shuttle 20 to near the top of mast 16. Drill bit 70 is connected to drill pipe 68 which is connected to quill 66. Swivel support rod 72 is then connected to power unit mount bracket 34. Swivel hose 73, mud pit return hose 77, and discharge hose 71 are connected to their respective ports in three way diverter valve 75. Discharge hose 71 and suction hose 76 are connected to pump 74. The drilling assembly 10 is now ready for drilling to begin.

Rotary power unit 60 is started and winch assembly 22 is engaged to lower drill bit 70 into the ground. Drill bit 70 then cuts or looses the earth. Drilling fluid is then directed from pump 74 through three way diverter valve 75 through swivel hose 71 and through swivel tee 64. Inside swivel tee 64 drilling fluid continues through quill 66 and drill pipe 68 into drill bit 70. The drilling fluid then lifts the bore hole cuttings up to the ground surface through an annulus formed between the outside of drill pipe 68 and the bore hole. As shuttle assembly is lowered to the top of support table 14, drilling is temporarily stopped and drill pipe 68 is disconnected from quill 66. Shuttle 20 is raised to allow a new section of drill pipe 68 to be threaded to quill 66. The breaking out and connecting of drill pipe 68 sections is performed on support table 14 with the combination slips 96 and insert 97 securing drill pipe 68. A wrench is used on breakout nut 99 to breakout or makeup drill pipe 68 to quill 66. Drilling operations can then continue after a section of drill pipe 68 is added or removed.

As porous subsurface formations are reached, the viscosity of the drilling fluid is increased and stabilized in mud pit 78 through the use of three way diverter valve 75. When the desired bore hole depth is reached, the drilling mud is stabilized to insure the integrity of the bore hole. Rotary power unit 60 is then rotated outward away or removed from mast 16 by removing either one or both hinge pins 56 from hinge 48 or hinge 50. Drill pipe 68 is then removed from the bore hole and casing is installed. If the hole collapses, rotary power unit 60 may be reconnected and drill resumed.

It will be apparent to those skilled in the art that various changes can be made in the details and construction of the apparatus disclosed herein without departing from the spirit and scope of the invention. Such changes and detail are included within the scope of this invention as defined in the following claims.

What I claim is:

1. A portable apparatus useful in drilling bore holes and which is specifically fabricated for manual disassembly, manual transport, and manual reassembly in various locations, said apparatus comprising:

a support base;

a mast connected to the support base;

a shuttle slidably mounted inside the mast;

a mounting bracket attached to the shuttle so that the mounting bracket is external to the mast and does not interfere with the slidability of the shuttle;

a winch assembly connected to the mast, such winch assembly comprising a reversible hand winch having at least one gear ratio; and a chain connected to the shuttle and directed through the winch assembly such that the shuttle is capable of being manually directed upwardly and downwardly along the mast;

whereby the mast is removable from the support base and the mounting bracket is removable from the shuttle so that the mast, the support base, and the mounting bracket may each be removed and manually transported as separated units, wherein the mounting bracket is attached to the shuttle through a hinge arrangement having two pins extending through the hinge arrangement, whereby the mounting bracket can be rotated out and away from over the bore hole by removing one of the pins or removed from the shuttle by removing both of the pins from the hinge arrangement.

2. A portable apparatus useful in drilling bore holes and which is specifically fabricated for manual disassembly, manual transport, and manual reassembly in various locations, said apparatus comprising:

a support base;

a mast connected to the support base;

a shuttle slidably mounted inside the mast;

a mounting bracket attached to the shuttle so that the mounting bracket is external to the mast and does not interfere with the slidability of the shuttle;

a rotary power unit connected to the mounting bracket;

a power output shaft extending from the rotary power unit;

a means for connecting the power output shaft to one end of a drill pipe;

a drill bit connected to an opposing end of the drill pipe from the power output shaft;

a winch assembly connected to the mast, such winch assembly comprising a reversible hand winch having at least one gear ratio; and a chain connected to the shuttle and directed through the winch assembly such that the shuttle is capable of being manually directed upwardly and downwardly along the mast;

whereby the mast is removable from the support base, and the mounting bracket and the rotary power unit are collectively removable from the power output shaft so that the mast, the support base, the mounting bracket and the rotary power unit, and the drill pipe may each be removed and manually transported as separate units, wherein the mounting bracket is attached to the shuttle through a hinge arrangement having two pins extending through the hinge arrangement, whereby the mounting bracket can be rotated out and away from over the bore hole by removing one of the pins or removed from the shuttle by removing both of the pins from the hinge arrangement.

* * * * *